United States Patent [19]

Rehbein

[11] 4,281,830

[45] Aug. 4, 1981

[54] LOG ROLL ARTICLE

[75] Inventor: Erwin G. Rehbein, Waupaca, Wis.

[73] Assignee: Mill-Craft Housing Corp., Waupaca, Wis.

[21] Appl. No.: 149,279

[22] Filed: May 12, 1980

[51] Int. Cl.[3] ..... A63B 23/06

[52] U.S. Cl. ..... 272/1 E; 29/463

[58] Field of Search ..... 272/1, 69; 220/DIG. 1, 220/DIG. 24, 216; 29/463

[56] References Cited

U.S. PATENT DOCUMENTS

| | | | |
|---|---|---|---|
| 2,086,134 | 7/1937 | Ludwick | 220/DIG. 24 |
| 3,193,286 | 7/1965 | Sitter | 272/1 E X |
| 3,845,952 | 11/1974 | McKinney | 272/1 E |
| 3,887,179 | 6/1975 | Klepper et al. | 272/1 E |
| 3,953,024 | 4/1976 | Brubacher | 272/1 E |

*Primary Examiner*—George J. Marlo

*Attorney, Agent, or Firm*—Russell L. Johnson

[57] ABSTRACT

A Log Roll article of manufacture for use in water recreation. The article is characterized by its fidelity to the properties of a natural log when the article is in use and by its novel and economical construction. The fabricated log is assembled from two substantially identical longitudinal half sections. A bulkhead terminates each end of the half sections. One bulkhead has a closable port through which water and air may pass when the port is open. The log is assembled by cementing two identical half sections together so that the port ends of the half sections are at opposite ends of the log. Water is permitted to enter or leave the log at one port while air is permitted to enter or leave the port at the other end of the log. The filling and emptying of the log with water is thereby facilitated. The log may be provided with longitudinal and circumferential inward directed projections or flanges for the purpose of retarding the rotation of the log and preventing rapid longitudinal displacement of water inside the log. These flanges give the log substantially the same pitch and roll characteristics of a natural log. The outer surface of the log is provided with a tractive surface.

8 Claims, 7 Drawing Figures

FIGURE 2
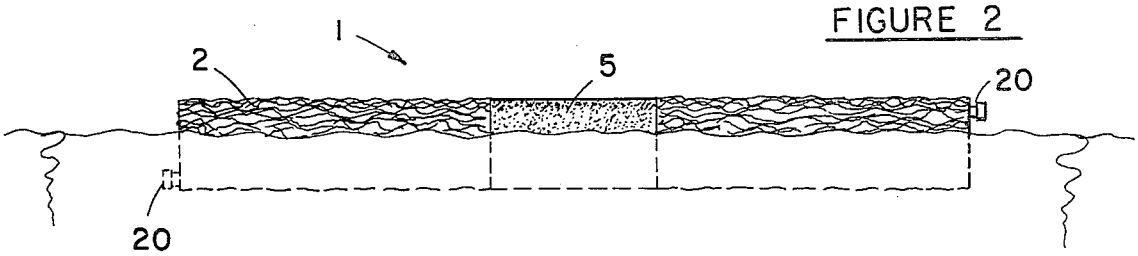
FIGURE 1
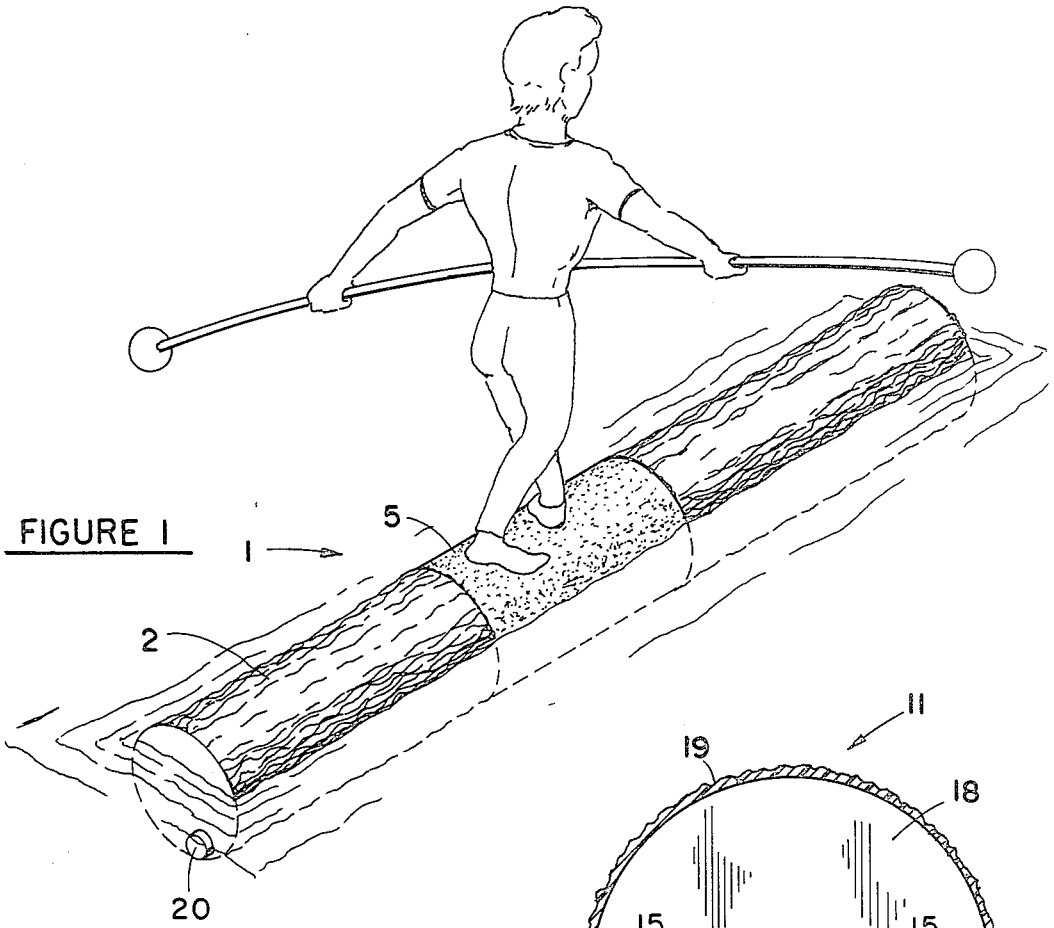
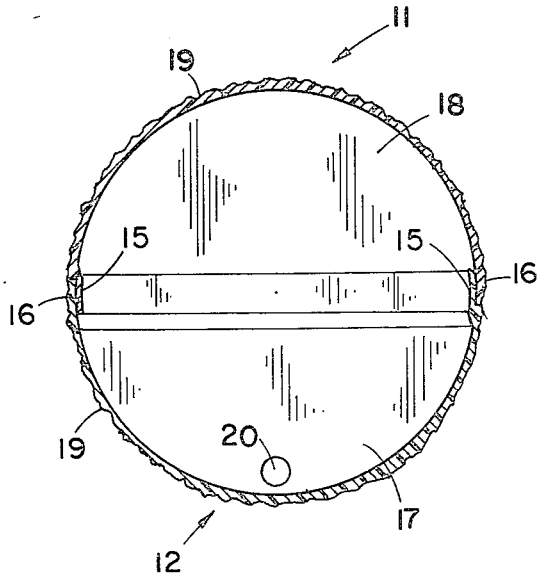
FIGURE 3

LOG ROLL ARTICLE

BACKGROUND OF THE INVENTION

Log rolling as a water sport or recreation at one time was a part of almost everyone's childhood. The advances in civilization which brought new logging methods, swimming pools, manicured public and private beaches and the like brought about the demise of log rolling as a wholesome and enjoyable water sport. Because of its size, weight, and tendency to decompose and grow moss the natural log has become impractical as a means for providing water recreation.

While the many drawbacks of the natural log make it impractical for many water recreation environments and situations the romance and genuine sense of pleasure which is found in log rolling has led many prior art inventors to attempt to make an artificial log which provides the joys of log rolling while attempting to overcome the inadequacies they see in a natural log. These attempts at providing log rolling articles of manufacture have not met with wide public acceptance and use. One may speculate that two of the reasons for the lack of public acceptance and commercial success of these log roll articles of manufacture are the cost and complexity of the articles and the lack of fidelity of the articles to the characteristics of a natural log and its manner of use and employment.

It is therefore an object of this invention to provide a log roll article of manufacture which is low in cost to manufacture and which at the time of use behaves in much the same manner as a natural log would.

It is further an object of this invention to provide a method of manufacture of a log roll article which is simple and novel.

It is further an object of this invention to provide a log roll article of manufacture which may be readily placed in and removed from the water and which is light in weight and readily transportable and storable when empty of water.

It is yet another object of this invention to provide a water fillable log roll article of manufacture which has internal restriction of the movement of water so that the article faithfully mimics the inertial properties of a natural log when in use.

DISCUSSION OF THE PRIOR ART

Prior art log roll devices have provided characteristics and elements which are not a part of a natural log. These devices make no claim to fidelity to the properties of a natural log and therefore it would be unjust to criticize their lack of that fidelity. However, fidelity to the characteristics of a natural log is a point of novelty of the instant invention and contrasting the instant invention with the prior art in this respect serves to support the claim of novelty of this invention with respect to the prior art.

The prior art, in trying to overcome some of the drawbacks of the natural log, have gone to some length to achieve their ends. U.S. Pat. No. 3,116,925 to Welch and U.S. Pat. No. 3,749,923 to Ung seek to stabilize their log roll devices in pitch and yaw and secure them positionally in a pool or other body of water.

U.S. Pat. No. 3,701,527 to Benton and U.S. Pat. No. 2,268,827 to Jackson provide means for arresting the roll of the log and ladder means for climbing upon the log to overcome the difficulties presented by a free rolling natural log when trying to get up on the log.

U.S. Pat. No. 2,175,197 to Kent provides an array of bearings, pulleys, weights as well as air and water filled chambers for the purpose of simulating the dynamics of a natural log.

U.S. Pat. No. 3,701,527, cited above, provides an integral means for trailoring the log roll article behind a towing vehicle while U.S. Pat. No. 3,633,905 to Etchelecou eliminates the water and provides a log roll device for use on dry land.

The above prior art devices seek to improve upon a natural log in some way or to make less the problems presented by a natural log while it is in use. In counter distinction, the instant invention seeks to maintain fidelity to the characteristics of a natural log while it is in the water. At the same time this inventor provides improved means for fabricating such a log roll article and provides characteristics which permit the ease of transport, storage, and the ease of launching and removing the log from the water.

BRIEF DESCRIPTION OF THE INVENTION

The invention in its simplest form is a log roll article of manufacture comprising two substantially identical longitudinal half sectioned hollow cylinder log forms, each half cylinder having bulkheads at its ends and one of the two bulkheads has a closable port passing therethrough. The port is positioned near the outside perimeter of the log. The edges of the half cylinder are formed so that when two such half cylinders are brought together so that the bulkheads which contain the ports are at opposite ends of the asembled log and diametrically opposite each other the edges around the perimeter will be in overlapping mating relationship with each other and when these overlapping mating edges are cemented to each other they form a water tight seal.

The log may be provided with inwardly directed longitudinal projections which serve to provide rotational inertia to the water filled log similar to the inertia of a natural log.

The log may also be provided with circumferential inwardly directed projections which serve to give the log stability in pitch and yaw similar to that of a natural log.

The log may be formed with a rough bark-like outer surface. It may be additionally supplied with a rug or other similar tractive surface in the midlength of the log to permit log rolling with tennis shoes or bare feet without excessive mechanical abrasion of the skin of the user.

BRIEF DESCRIPTION OF THE DRAWINGS

FIG. 1 is a pictorial view of the log roll article of this invention as it would appear in use.

FIG. 2 is an elevational view of the article of this invention in relation to a body of water.

FIG. 3 is a lateral cross sectional view of the article of this invention.

DETAILED DESCRIPTION OF THE INVENTION

Figure 4:
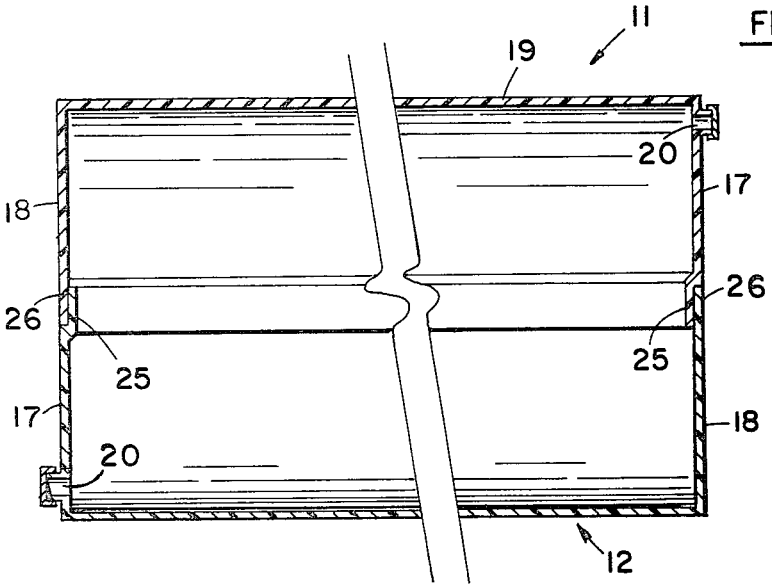
FIG. 4 is a longitudinal cross section of the article of this invention.
Figure 5:
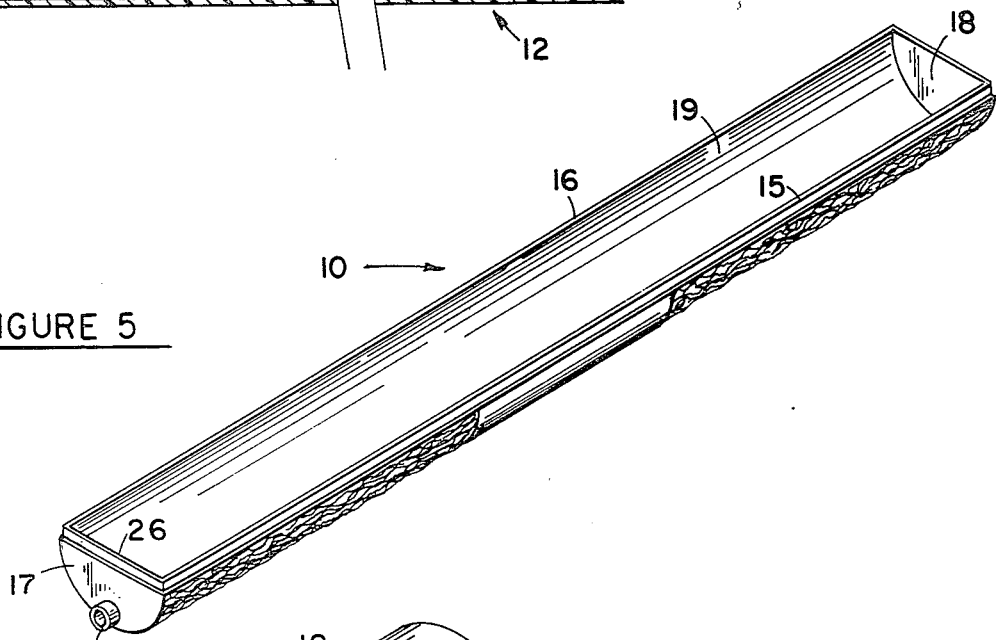
FIG. 5 is a pictorial view of a longitudinal cylindrical half sectional element of this invention.

Log rolling requires for its enjoyment a log large enough to support a person when the log is floating in a body of water and a person to attempt to stay on the log. The size and inertia of the log combine to provide an unsteady and unstable platform upon which to perch. Natural logs of the size required to enjoy log rolling are no longer readily at hand in most water recreation areas. Transporting a natural log to and from and launching and removing it from the water would require relatively heavy equipment. This invention provides a light weight easily transported hollow cylinder which, when filled with water, closely mimics the behavior of a natural log when floating in a body of water. Referring now to FIG. 1. Log roll article 1 is an elongate cylinder having a bark-like irregular texture 2 on its outer surface. This texture 2 provides a degree of resistance to rotation of the log in the water.

Carpeting 5 is wrapped around a portion of the midlength of log 1. Carpeting 5 serves to provide a tractive surface to the midlength of log 1 which is not overly abrasive to the skin and feet of the user.

Referring now to FIGS. 1 through 5.

Log roll article 1 is assembled from two substantially identical longitudinal cylindrical half sections 10. For distinction herein one half section 10 of article 1 shall hereinafter be referred to as upper half section 11 and the outer half section of article 1 shall be referred to as lower half section 12. The use of two identical half sections to form the article of this invention enables the economical manufacture of the article. This is particularly true when the article is formed by the molding of fiberglass which is the preferred method.

One longitudinal edge of the half section 10 is provided with an offset lip 15 and its opposite member which is longitudinal edge 16 fits closely to and mates with offset lip 15 so that when upper half section 11 and lower half section 12 are fixedly joined together as shown in FIG. 3, lip 15 and its opposite member 16 form a water tight joint.

Half section 10 has semicircular bulkheads 17 and 18 positioned at the ends of half cylinder shell 19. Bulkheads 17 has closable port 20 passing therethrough and port 20 is positioned near the line of meeting between shell 19 and bulkhead 17. Bulkhead 17 has at its upper edge offset lip 25 similar to lip 15 of shell 19, and offset lip 25 mates with its opposite member which is edge 26 of bulkhead 18. Lip 25 and edge 26 are brought into mating contact as shown in FIG. 4 and fixedly joined to form a water tight seal.

In the preferred embodiment half sections 10 are of molded fiberglass and the method of fixedly joining the half sections together to form a water tight seal is by means of fiberglass cement. It should be understood that half sections 10 may be fabricated from metal and the means of fixed joining to form a water tight seal may be by riveting or welding or any other means which is serviceable.

When lips 15 and 25 are mated with their opposite members which are edges 16 and 26 respectively, ports 20 will be positioned at opposite ends of the article and diametrically opposed as illustrated in FIG. 4. This positioning of ports 20 is well suited to filling the article with and emptying the article of water. With ports 20 open, water may enter or exit one port while air enters or leaves the other port. This arrangement permits the rapid filling of the article with water when preparing it for use and also permits the rapid emptying of the water from the article when removing it from the water for transporting or storage. The closure of ports 20 may be any conventional abrasive such as a screw type cap or the like.

In order to support a full grown man, a floating log of considerable size and mass is required. The size and inertia of the log is an important element of the sport of log rolling. Therefore, in order to mimic the characteristics of a natural log the size of the article of this invention is in the order of fourteen feet long and a foot and a half in diameter.

The article is filled with water to provide the mass required to mimic the weight of a natural log and to lower the center of buoyancy to substantially that shown in FIGS. 1 and 2.

Considerable skill is required to merely sit astride a floating log. Additional skill is required to stand on a floating log. When these skills are mastered the user may deliberately start the log to rolling and attempt to remain standing. Because the water inside the article supplies the major portion of the mass of the log roll article when in use, it is desirable that it also provide the inertial resistance to rotation to mimic the natural inertia provided by a natural log.

Figure 6:
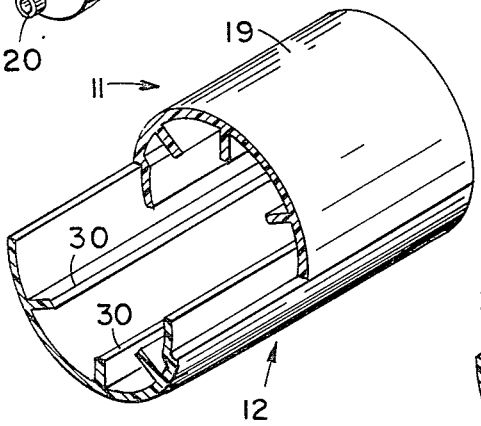
FIG. 6 is a pictorial partially sectioned view of an embodiment of this invention wherein longitudinal inward directed baffles are provided.

Referring now to FIG. 6. Article 1 may be provided with a multiplicity of inwardly directed longitudinal flanges 30.

Figure 7:
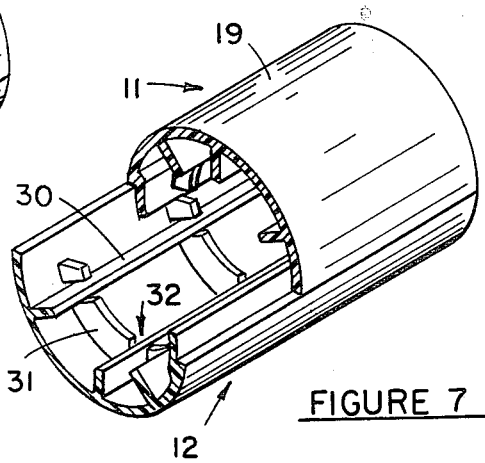
FIG. 7 is a pictorial partially sectioned view of an embodiment of the invention wherein circumferential inward directed baffles are provided.

In order to restrict the rapid movement of water from one end of article 1 to the other inward directed circumferential baffles may be provided as shown in FIG. 7. Baffles 31 may be interrupted as shown at 32 in order to permit water to be drained from the length of article 1.

Thus it is seen that this invention provides for a novel means for fabricating and providing a log roll article of manufacture which closely mimics the behavior of a natural log when the article is used in the water and which article is readily stored, transported, placed in and removed from the water and which is economical to manufacture and is durable and long lasting.

The preferred embodiment of the invention has been disclosed herein but it should be understood that the scope of the invention should be limited only to the scope of the appended claims and all equivalents thereto which would become apparent to one skilled in the art.

I claim:

1. A log roll article of manufacture comprising; two substantially identical longitudinal cylindrical half sections having an ouside half cylinder hollow shell and semicircular bulkheads at the ends of the shell and one of the bulkheads has a closable port passing therethrough at a location near the line of meeting between the bulkhead and the shell and one longitudinal edge of the shell has an offset lip and one bulkhead has a similar offset lip and the offset lips are configured so that when two such cylindrical half sections are placed together so that there is a bulkhead having a port at each end of the assembled cylindrical half sections the offset lips fit closely inside their opposite member which is not offset and the offset members are fixedly joined to their opposite members so as to form a substantially water tight hollow cylinder having diametrically opposed closable ports at each end.

2. The log roll article of manufacture of claim 1 wherein the outside surface of the hollow cylinder is provided with an irregular bark-like surface and the longitudinal cylindrical half sections are formed of molded fiberglass and the means of fixedly joining the two half sections is by means of fiberglass cement.

3. The log roll article of manufacture of claim 1 wherein the hollow cylindrical shell is provided with a multiplicity of inward directed longitudinal baffles.

4. The log roll article of manufacture of claim 3 wherein the hollow cylindrical shell is provided with a multiplicity of substantially circumferential inwardly directed baffles which are discontinuous at several locations around their perimeter.

5. The log roll article of manufacture of claim 4 wherein the circumference of the midportion of the hollow cylinder is covered with a material which affords tractive footing when wet.

6. The log roll article of manufacture of claim 1 wherein the half sections are formed of metal and the method of fixedly joining the two half sections is by means of riveted water tight seaming.

7. The log roll article of manufacture of claim 6 wherein the hollow cylindrical shell is provided with a multiplicity of inward directed longitudinal baffles.

8. The log roll article of manufacture of claim 7 wherein the circumference of the midspan of the hollow cylinder is covered with a material which affords tractive footing when wet.

* * * * *